US009574417B2

(12) United States Patent
Laird et al.

(10) Patent No.: US 9,574,417 B2
(45) Date of Patent: Feb. 21, 2017

(54) WIRELINE HYDRAULIC DRIVEN MILL BOTTOM HOLE ASSEMBLIES AND METHODS OF USING SAME

(71) Applicant: Baker Hughes Incorporated, Houston, TX (US)

(72) Inventors: Mary L. Laird, Madisonville, LA (US); Robbie B. Colbert, Perdido, AL (US); David W. Coleman, Broussard, LA (US)

(73) Assignee: Baker Hughes Incorporated, Houston, TX (US)

( * ) Notice: Subject to any disclaimer, the term of this patent is extended or adjusted under 35 U.S.C. 154(b) by 436 days.

(21) Appl. No.: 13/910,193

(22) Filed: Jun. 5, 2013

(65) Prior Publication Data

US 2014/0360724 A1 Dec. 11, 2014

(51) Int. Cl.
*E21B 31/20* (2006.01)
*E21B 31/00* (2006.01)

(52) U.S. Cl.
CPC ..... *E21B 31/002* (2013.01)

(58) Field of Classification Search
CPC ..... E21B 4/02; E21B 4/18; E21B 12/06; E21B 29/002; E21B 31/16
See application file for complete search history.

(56) References Cited

U.S. PATENT DOCUMENTS 2,880,804 A * 4/1959 Fredd ..... E21B 29/00 166/55.8
2,942,666 A 6/1960 True et al.
3,032,116 A 5/1962 Barry
3,057,406 A 10/1962 Patterson et al.
3,083,774 A 4/1963 Peters et al.
4,646,856 A * 3/1987 Dismukes ..... E21B 4/02 175/107
5,331,607 A 7/1994 Roessler
5,404,946 A 4/1995 Hess
6,276,452 B1 8/2001 Davis et al.
6,341,654 B1 1/2002 Wilson et al.
6,345,669 B1 2/2002 Buyers et al.
6,752,205 B2 6/2004 Kutac et al.
6,886,631 B2 5/2005 Wilson et al.
6,915,845 B2 7/2005 Leising et al.
8,403,048 B2 3/2013 Laird et al.
2003/0221830 A1 12/2003 Leising et al.
2004/0020644 A1 2/2004 Wilson et al.
(Continued)

OTHER PUBLICATIONS

Technical Design's Stroking Pump, Technical Design, p. 1.
TAM SlikPak flyer, TAM International, pp. 1-4.
TAM SlikPak flyer, TAM International, pp. 1-2.

*Primary Examiner* — William P Neuder
(74) *Attorney, Agent, or Firm* — Steve Rosenblatt

(57) ABSTRACT

A bottom hole assembly for engaging and removing an object within a wellbore comprises a cutting tool at a lower end. Continued engagement of the cutting tool with the object is facilitated by an axial compression device disposed within the bottom hole assembly below the anchor of the bottom hole assembly. The axial compression device comprises a compressed position and an expanded or extended position. As the object is being cut or abraded, the axial compression device moves from the compressed position toward the expanded position so that a continued downward force is transferred to the object by the bottom hole assembly.

20 Claims, 4 Drawing Sheets

(56) References Cited

U.S. PATENT DOCUMENTS

| | | | | |
|---|---|---|---|---|
| 2005/0126791 | A1 | 6/2005 | Barbee et al. | |
| 2006/0081380 | A1 | 4/2006 | Hoffman et al. | |
| 2009/0114389 | A1 | 5/2009 | Dennistoun et al. | |
| 2010/0236781 | A1 | 9/2010 | Mytopher et al. | |
| 2010/0258296 | A1 | 10/2010 | Lynde et al. | |
| 2011/0297379 | A1 | 12/2011 | Laird et al. | |
| 2012/0145394 | A1* | 6/2012 | Jensen ..... | E21B 4/006 166/298 |

* cited by examiner

WIRELINE HYDRAULIC DRIVEN MILL BOTTOM HOLE ASSEMBLIES AND METHODS OF USING SAME

BACKGROUND

1. Field of Invention

The invention is directed to bottom hole assemblies having a mill or cutting tool rotatably driven by a hydraulically actuated motor in the bottom hole assembly to abrade or cut away an object disposed in oil and gas wells, and in particular, to bottom hole assemblies disposed on wireline that permit axial movement of a portion of the bottom hole assembly below an anchor point within the well to facilitate engagement of the mill or cutting tool with the object.

2. Description of Art

In the drilling, completion, and workover of oil and gas wells, it is common to perform work downhole in the wellbore with a tool that has some sort of cutting profile interfacing with a downhole structure. Examples would be milling a downhole metal object with a milling tool or cutting through a tubular with a cutting or milling tool. Such milling may be necessary to remove an object or "fish" disposed within the wellbore. In general, milling operations are performed using a mill tool attached to threaded pipe or coiled tubing through which a fluid such as drilling mud is pumped. The fluid causes a hydraulically actuated motor disposed above the mill tool to rotate which, in turn, causes the mill tool to rotate and the object to be abraded or cut away. To facilitate cutting, a hydraulically actuated anchor can be included in the threaded pipe or coiled tubing string to stabilize the string within the well.

SUMMARY OF INVENTION

Broadly, the bottom hole assemblies disclosed herein are run-in to a wellbore on a wireline as opposed to threaded pipe or coiled tubing. Disposed within the bottom hole assemblies is an axial compression device that permits axial movement of a lower portion of the bottom hole assemblies disposed below an anchor or packer. The lowermost ends of the bottom hole assemblies include a cutting or milling tool such as a mill or shoe that is rotated to cut away or abrade an object disposed in the wellbore. The axial movement of the lower portion of the bottom hole assemblies facilitates cutting the object disposed within the wellbore by providing an increase in downward force on the object to facilitate maintaining engagement of the mill with the object.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
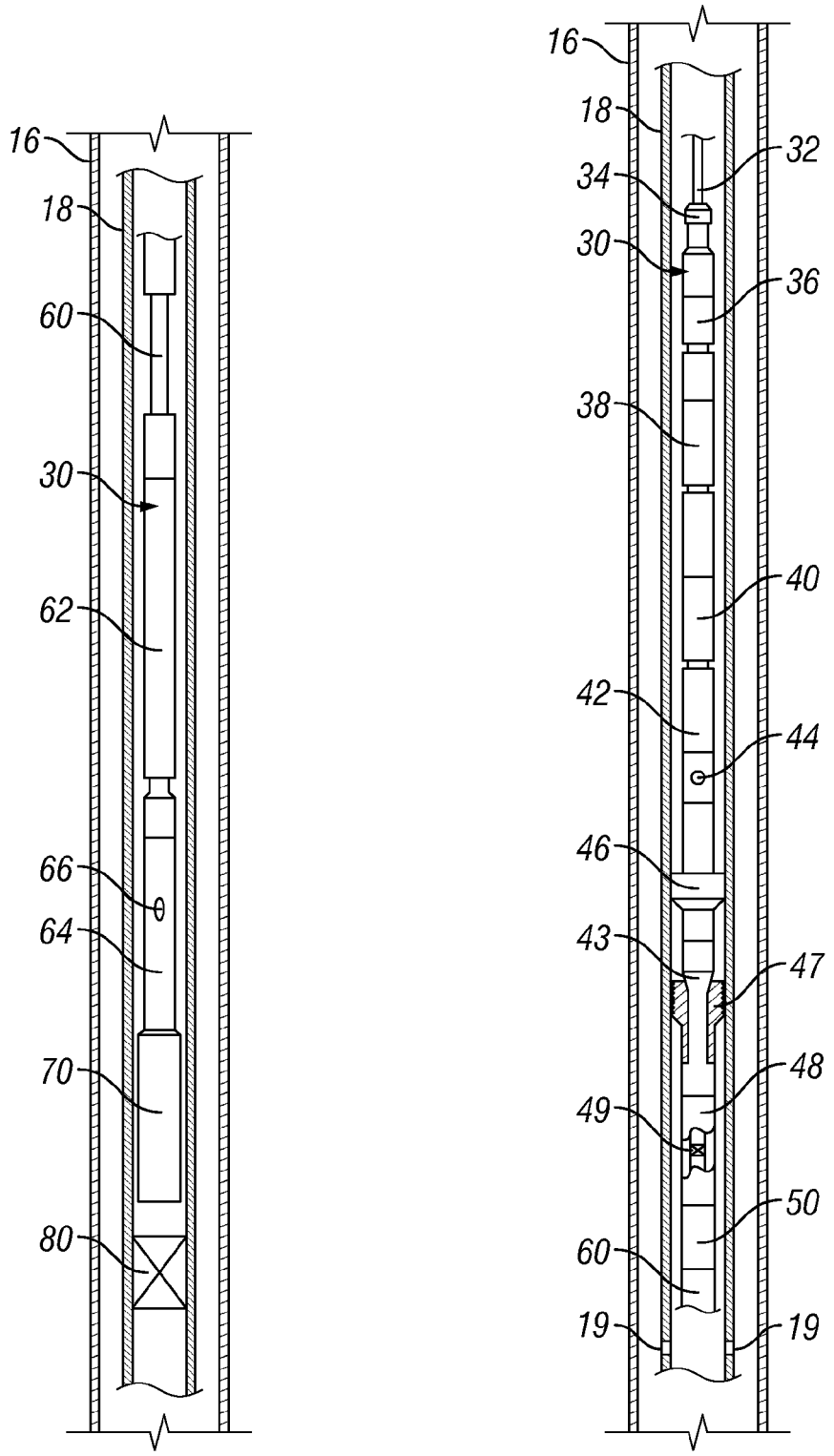
FIG. 1 is a partial-cross-sectional view of a specific embodiment of a bottom hole assembly disclosed herein shown in its run-in position within a production tubing disposed in a cased wellbore.
Figure 2:
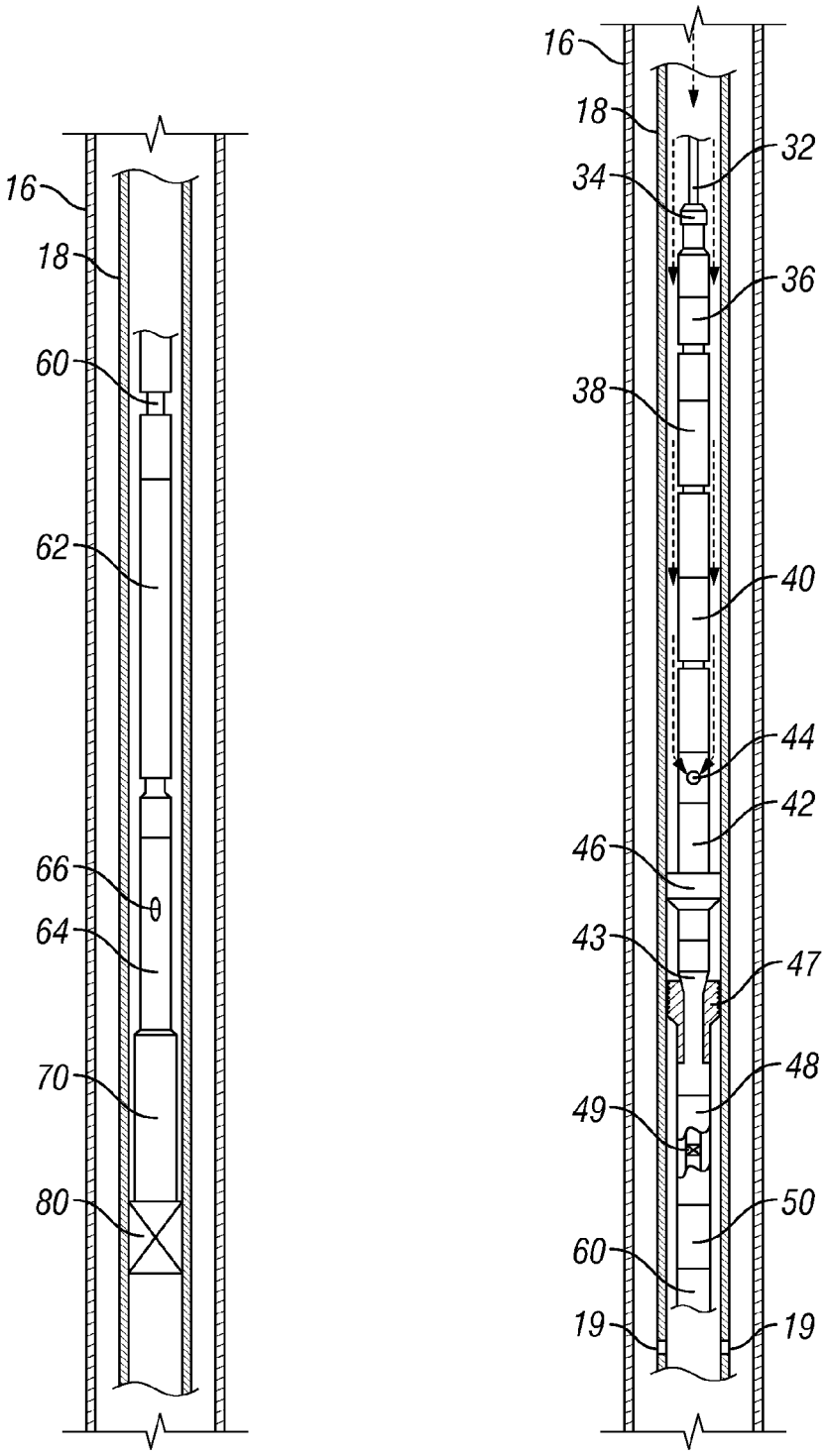
FIG. 2 is a partial cross-sectional view of the bottom hole assembly shown in FIG. 1 showing the mill engaged with an object disposed within the production tubing prior to milling operations commencing.
Figure 3:
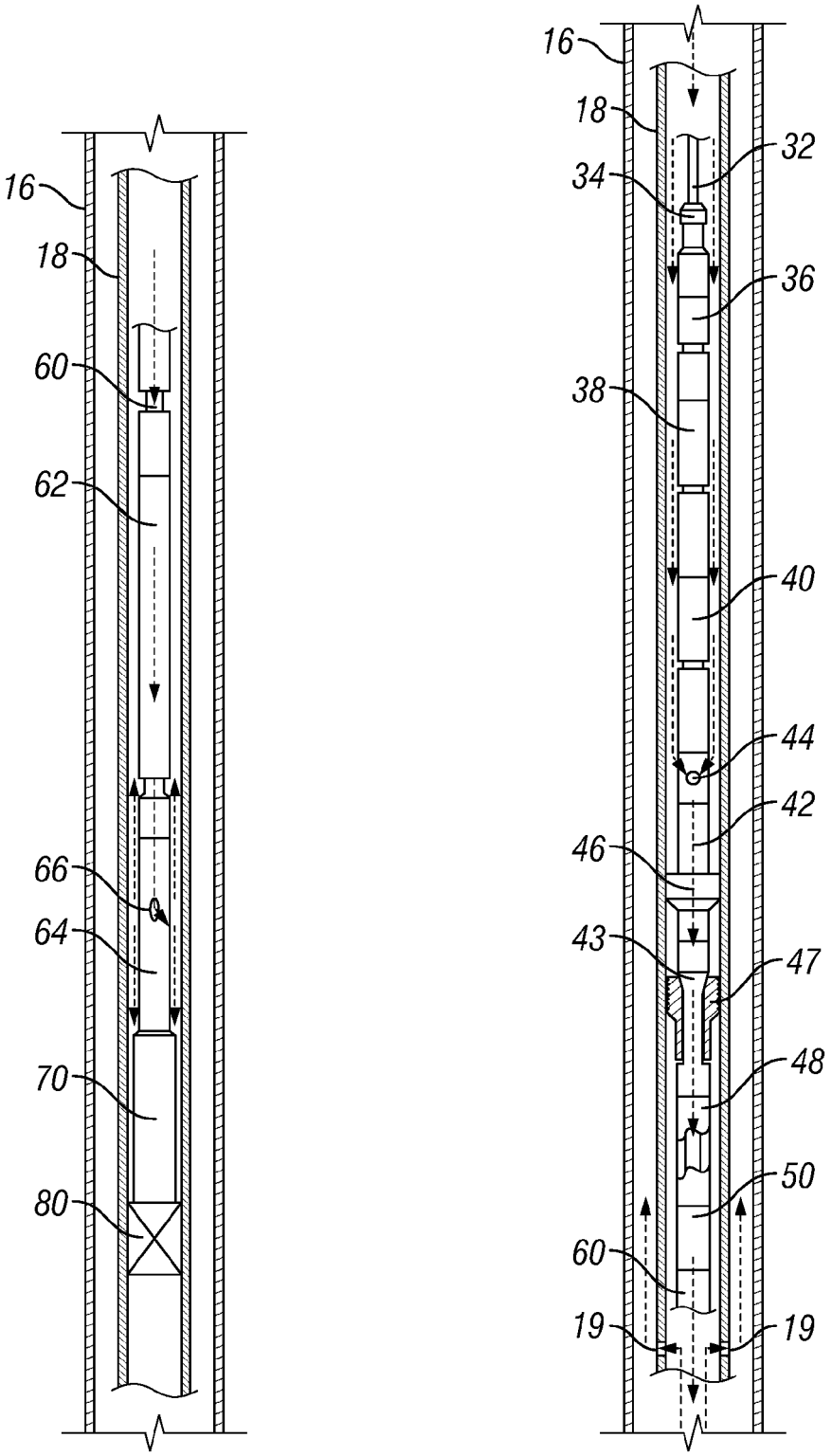
FIG. 3 is a partial cross-sectional view of the bottom hole assembly shown in FIG. 1 showing the mill engaged with an object disposed within the production tubing during milling operations.

Referring now to FIGS. 1-3, in one particular embodiment, bottom hole assembly 30 is disposed within a cased wellbore 16 having production tubing 18 disposed therein. Stuck within production tubing is object or fish 80 which may be a stuck tool, a stuck piece of tubing, a packer, or other isolation member that is desired to be removed, and the like.

In the embodiment of FIGS. 1-3, bottom hole assembly 30 is deployed within production tubing 18 via wireline 32. As used herein, the term "wireline" includes electric line, braided line, slickline, and the like. As discussed in greater detail below, bottom hole assembly 30 includes hydraulically actuated anchor 47 and hydraulically actuated motor 62. Both of these devices are operable within production tubing 18 even though they are part of a bottom hole assembly 30 that is run-in the production tubing 18 on wireline 32 as opposed to being deployed on threaded pipe or coiled tubing. In addition to being able to operate the hydraulically actuated anchor 47 and the hydraulically actuated motor 62 disposed within the wireline-run bottom hole assembly, bottom hole assembly 30 permits axial movement of a portion of bottom hole assembly 30 disposed below the packer 46 and/or the anchor 47 which, as discussed in greater detail below, secures bottom hole assembly 30 within production tubing 18.

As shown in the embodiment of FIGS. 1-3, bottom hole assembly 30 is releasably secured to wireline 32 through wireline connector devices and methods known in the art. As shown in FIGS. 1-3, the wireline connector comprises fishing neck 34.

Swivel 36 is disposed below fishing neck 34 to reduce any residual torque through wireline 32 back to the surface of the well. Disposed below swivel 36 is wireline accelerator 38 and wireline jar tool 40, both of which facilitate retrieval of bottom hole assembly 30 during fishing operations in the event bottom hole assembly 30 becomes stuck within production tubing 18. Below wireline jar tool 40 is drain sub 42 having drain sub port 44 which allows fluid flow from production tubing 18 to the inner diameter or bore 43 of bottom hole assembly 30. Below drain sub 42 is packer 46 which can be a pack-off or mechanical or electrical set packer. Packer 46 forces the fluid flow from production tubing 18 into drain sub 42.

Below packer 46 is hydraulic actuated anchor 47 (shown in the run-in position in FIGS. 1-2 and in the set position in FIG. 3) which anchors bottom hole assembly 30 within production tubing 18 to prevent bottom hole assembly 30 from sliding up/down within production tubing 18 and to hold torque created by motor 62 (discussed in greater detail below). Although anchor 47 is included in bottom hole assembly 30, it is to be understood that anchor 47 is not required. Instead, in some specific embodiments, packer 46 can provide the same functions as anchor 47. Rupture disk sub 48 disposed below anchor 47 having rupture disk 49 within the inner diameter or bore 43 of rupture disk sub 48 and, thus, bottom hole assembly 30 to stop any type of fluid flow to motor 62 before anchor 47 is set. Screen sub 50 is disposed below rupture disk sub 48 to catch any debris from rupture disk sub 48 after rupture disk 49 has been ruptured so as to prevent damage to motor 62.

Below screen sub 50 is axial compression device 60 which allows for axial movement of a portion of bottom hole assembly 30 within production tubing 18 below packer 46 and/or anchor 47. Axial compression device 60 has an expanded position (FIG. 1) and a collapsed or compressed (FIGS. 2-3). In the embodiment of FIGS. 1-3, axial compression device 60 is a compensator having a tensioning cylinder with a rod that is biased toward the expanded position. The biasing of the rod of the tensioning cylinder can be provided by a spring or Bellville washer (not shown) or by hydraulic or other fluid within the tensioning cylinder. Alternatively, the compensator can be gravity assisted such that gravity causes the biasing of compensator toward the expanded position.

Disposed in bottom hole assembly 30 below axial compression device 60 is hydraulic mud motor 62 which rotates mill or shoe 70 and, below motor 62 is a junk basket such as venturi jet basket 64 having ports 66. As discussed in greater detail below, venturi jet basket 64 captures any debris created by mill 70 during cutting or abrading operations by mill 70.

In operation of the embodiment of FIGS. 1-3, bottom hole assembly 30 is secured to wireline 32 and run-in production tubing 18 (FIG. 1) until mill 70 contacts or engages object 80 (FIG. 2). During run-in (FIG. 1), axial compression device 60 is in an extended or expanded position. Upon engaging object 80, axial compression device 60 is activated by, for example, the weight of bottom hole assembly 30 being allowed to push down on object 80 such as by slacking off wireline 32. Activation of axial compression device 60 causes compression or collapse, i.e., lessening of the overall length of axial compression device 60 so that axial compression device 60 is in a collapsed or compressed position (FIGS. 2-3). In the embodiments in which a Bellville washer or spring is included in axial compression device 60, such Bellville washer or spring becomes energized. By activating axial compression device 60, more downward force is transferred to object 80 to facilitate cutting or abrading object 80 by facilitating continued engagement of mill 70 with object 80.

After being disposed within production tubing 18 as shown in FIG. 2, packer 46 is actuated to seal or isolate a portion of production tubing 18. Actuation of packer 46 can be through mechanical or electrical means. Thereafter, a fluid such as mud is pumped down production tubing 18 as indicated by the arrows shown in FIG. 2. The fluid enters the inner diameter or bore 43 of bottom hole assembly through port 44 of drain sub 42. As the pressure of the fluid builds within bore 43, anchor 47 is actuated causing anchor 47 to engage the inner wall surface of production tubing 18 (FIG. 3). Thereafter, the fluid continues to build up pressure within bore 43 of bottom hole assembly 30 until rupture disk 49 fails or ruptures. As a result of rupture disk 49 failing, fluid flows down through bore 43 of bottom hole assembly 30 as indicated by the arrows shown in FIG. 3. The fluid causes motor 62 to rotate which, in turn, causes mill 70 to rotate to cut or abrade object 80. The fluid exits bore 43 of bottom hole assembly 30 through port 66 disposed in venturi jet basket 64. Fluid exiting port 66 flows both downward to object 80 and upward within production tubing 18. As the fluid flows upward, it passes the top of venturi jet basket 64. In so doing, some of the debris within the fluid enters the top of venturi jet basket 64 where some of the debris within the fluid can be captured. Fluid not flowing into venturi jet basket 64, or flowing downward to object 80, continues to flow upward until it reaches ports 19 disposed in production tubing 18.

Ports 19 are disposed below the location of packer 46 and anchor 47 so that pumping of fluid down production tubing 18 can be continued until object 80 is cut away. Thus, ports 19 facilitate circulation of fluid downward through bottom hole assembly 30. Ports 19 can be disposed in production tubing 18 through any device or method known in the art. For example, a perforation gun can be used to create ports 19.

After object 80 is removed from within production tubing 18, axial compression device 60 will return to its extended position (FIG. 1) and bottom hole assembly 30 can be retrieved from production tubing 18 by retracting wireline 32.

Figure 4:
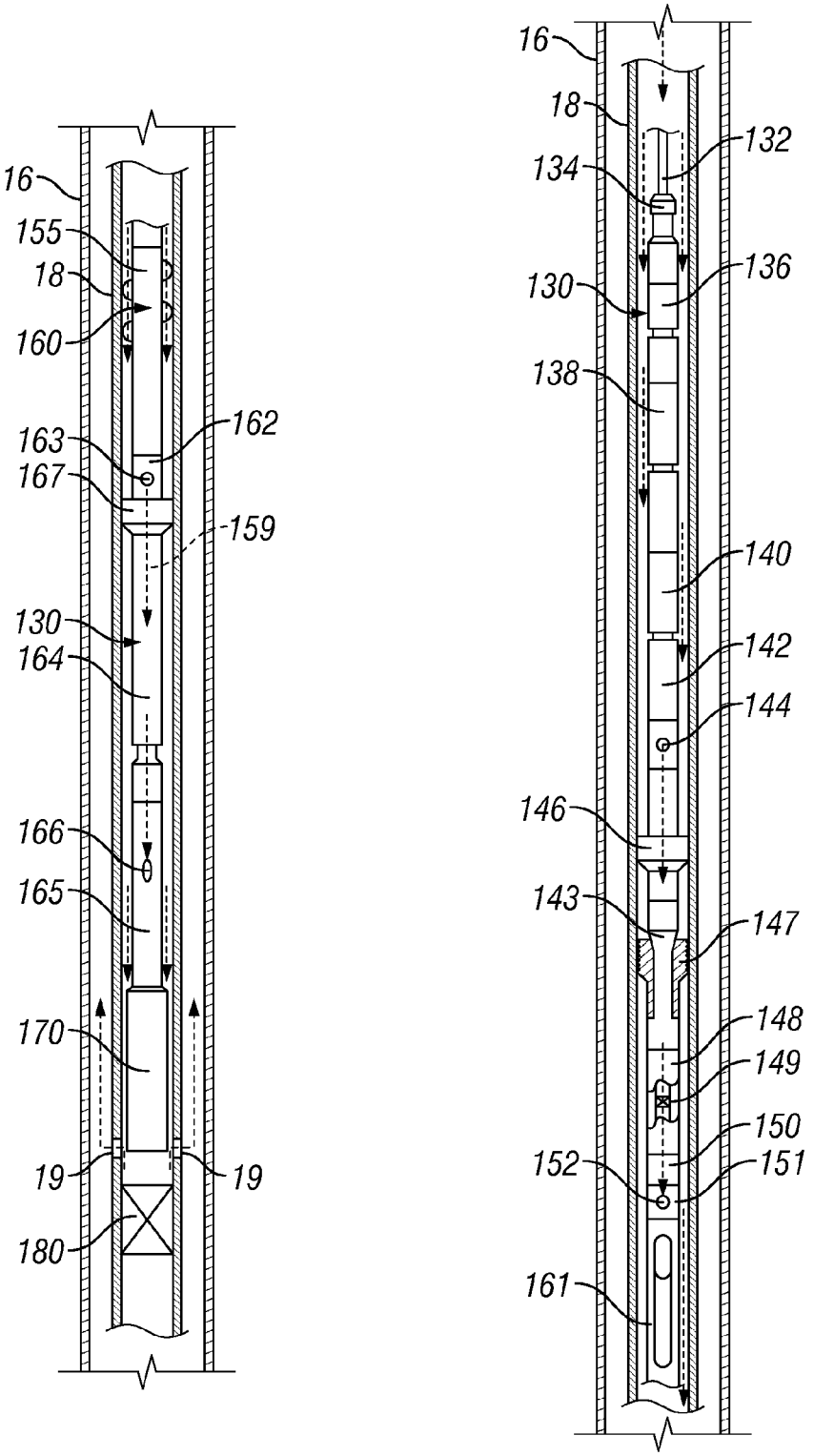
FIG. 4 is a partial-cross-sectional view of another specific embodiment of a bottom hole assembly disclosed herein shown in its run-in position within a production tubing disposed in a cased wellbore.

Referring now to FIG. 4, in another embodiment, bottom hole assembly 130 is disposed within production tubing 18 of cased wellbore 16. Bottom hole assembly 130 is releasably connected to wireline 132 by fishing neck 134. Bottom hole assembly 130 also includes swivel 136 to reduce any residual torque through wireline 132 back to surface; wire line accelerator 138 and wireline jar tool 140 to aid in fishing operations if bottom hole assembly 130 happens to get stuck within production tubing 18; first drain sub 142 having port 144 to allow the fluid flow from production tubing 18 to the inner diameter or upper bore 143 of bottom hole assembly and, thus, to hydraulically actuated anchor 147 for actuation or setting of anchor 147; packer 146 which can be a pack-off or mechanical or electrical set packer which forces fluid flow from production tubing 18 into port 144 of first drain sub 142; hydraulically-actuated anchor 147 to maintain bottom hole assembly 130 within production tubing 18 so that bottom hole assembly 130 does not slide up or down within production tubing 18 and to hold torque created by motor 164 (discussed in greater detail below); rupture disk sub 148 disposed below anchor 147 having rupture disk 149 disposed within the fluid flow path, i.e., upper bore 43 of bottom hole assembly 130, through anchor 147 to stop any type of fluid flow to motor 164 before anchor 147 is set; screen sub 150 to catch any debris from rupture disk 149 after it has been ruptured so as to prevent damage to motor 164; second drain sub 151 having port 152 to allow fluid flow from upper bore 143 back into production tubing 18 so as to lessen the likelihood that anchor 147 will become hydraulically locked and to direct fluid around slack joint 161 and tractor 155; and axial compression device 160 to allow for downward movement of the portion of bottom hole assembly 130 below packer 146 and anchor 147 and, in particular, to allow mill or mill shoe 170 to mill or wash over object 180.

In the embodiment of FIG. 4, axial compression device 160 comprises electric tractor 155 operatively associated with wire line jar tool or slack joint 161 disposed above electric tractor 155. Electric tractor 155 can be powered by an on-board power source such as a battery, or by electrical power transmitted through a line from the surface of the wellbore. In the embodiments in which electrical power is transmitted through a line from the surface of the wellbore, the electric line can be threaded down electric tractor 155 either along the outside of all of the components of bottom hole assembly 130 down to electric tractor 155, or down along the outside of the components of bottom hole assembly 130 above first drain sub 142 and then through port 144 and down through the inner diameter or upper bore 143 of the bottom hole assembly 130, including through rupture disk sub 148, to electric tractor 155.

Operatively associated with tractor 155 is wireline jar tool or slack joint 161 which is a mechanical two part tool that has free axial travel caused by activation of tractor 155.

Below tractor 155 is third drain sub 162 having port 163 to allow fluid flow from production tubing 18 to lower bore 159 of bottom hole assembly and, thus, into motor 164 and venturi jet basket 165 having port 166.

Flow of fluid from production tubing to inside motor 164 and venturi jet basket 165 is facilitated by packer 167 disposed below third drain sub 162. Packer 167 can be actuated mechanically in a similar manner as packer 146. Packer 167 is in axial sliding engagement with the inner wall of production tubing 18 so that axial compression and extension of slack joint 161 by actuation of tractor 155 causes packer 167 to slide axially within production tubing 18. Thus, packer 167 directs fluid flow into port 163 of third drain sub 162 and functions as a piston within production tubing 18 to facilitate movement of the lower portion of bottom hole assembly 130 below slack joint 161.

Like the embodiment of FIGS. 1-3, motor 164 is a hydraulic mud motor that produces the rotation to mill/shoe 170 and venturi jet basket 165 captures any debris created by mill/shoe 170 during cutting or milling operations. Mill/shoe 170 is disposed at the lower end of bottom hole assembly 130.

In operation of the embodiment of FIG. 4, bottom hole assembly 130 is secured to wireline 132 and run-in production tubing 18 until mill 170 contacts or engages object 180. During run-in (FIG. 4) axial compression device 160 is in an extended axial position. Upon engaging object 180, slack joint 161 is compressed, or shortened in length as electric tractor 155 is not activated to provide resistance to such compression. After being placed in position, electric tractor 155 is activated by, for example, electric power from wireline 132 or electrical power from an on-board power source. Activation of electric tractor 155 causes extension of, i.e., increasing, the overall length of bottom hole assembly 130 so that slack joint 161 is extended in length and, thus, axial compression device 160 is moved toward an extended position. By activating electric tractor 155, more downward force is transferred to object 180 from bottom hole assembly 130 to facilitate cutting or abrading object 180 and to facilitate continued engagement of mill 170 with object 180 during cutting operations.

After being disposed within production tubing 18 and engaged with object 180, packers 146, 167 are actuated to seal or isolate portions of production tubing 18. Actuation of packers 146, 167 can be through mechanical means. Thereafter, a fluid such as mud is pumped down production tubing 18 as indicated by the arrows shown in FIG. 4. The fluid enters port 144 of drain sub 142 into an inner diameter or upper bore of bottom hole assembly 130. As the pressure of the fluid builds, anchor 147 is actuated causing anchor 147 to engage the inner wall surface of production tubing 18.

Thereafter, the fluid continues to build up pressure within the inner diameter or upper bore of bottom hole assembly 130 until rupture disk 149 fails or ruptures. As a result of rupture disk 149 failing, fluid flows down through the upper bore of bottom hole assembly 130 as indicated by the arrows shown in FIG. 4. The fluid then exits the upper bore of bottom hole assembly 130 through port 152 of second drain sub 151 and into production tubing 18 where it continues to flow downward.

The downward flowing fluid then enters a lower bore of bottom hole assembly 130 by flowing through port 163 of third drain sub 162. Flow of fluid into port 163 is facilitated by second packer 167. The fluid then flows downward through motor 164 causing motor 164 to rotate which, in turn, causes mill 170 to rotate to cut or abrade object 180. The fluid exits bottom hole assembly 130 through port 166 disposed in venturi jet basket 165. Some of the fluid exiting port 166 picks up debris and carries the debris to the top of venturi jet basket 165 so that it can be captured by a debris catcher assembly below the venturi jet basket 165. Other portions of the fluid continue to flow downward, past mill 170 and out of ports 19 disposed within production tubing 18. Ports 19 are disposed below the location of packers 146, 167, and anchor 147 so that pumping of fluid down production tubing 18 can be continued until object 180 is cut away. Thus, ports 19 facilitate circulation of fluid downward through bottom hole assembly 130. As mentioned above, ports 19 can be formed through any device or method known in the art, including but not limited to, a perforation gun.

After object 180 is removed from within production tubing 18, bottom hole assembly 130 can be retrieved from production tubing 18 by retracting wireline 132. If desired, electric tractor 155 can be activated to return to its initial or run-in position before bottom hole assembly is retrieved.

It is to be understood that the invention is not limited to the exact details of construction, operation, exact materials, or embodiments shown and described, as modifications and equivalents will be apparent to one skilled in the art. For example, the term "wireline" includes electric line, braided line, slickline, and the like. Moreover, the bottom hole assemblies disclosed with reference to the Figures are not limited to the components identified therein. To the contrary, one or more additional components can be included in the bottom hole assemblies such as a perforation gun or other device for creating ports 19 in the production tubing. Moreover, in some embodiments, the anchor is not required as one or more packers can provide the same functions as the anchor. Additionally, it is to be understood that the term "wellbore" as used herein includes open-hole, cased, or any other type of wellbores. In addition, the use of the term "well" is to be understood to have the same meaning as "wellbore." Moreover, in all of the embodiments discussed herein, upward, toward the surface of the well (not shown), is toward the top of Figures, and downward or downhole (the direction going away from the surface of the well) is toward the bottom of the Figures. However, it is to be understood that the bottom hole assemblies disclosed herein may have their positions rotated in either direction any number of degrees. Accordingly, the bottom hole assemblies can be used in any number of orientations easily determinable and adaptable to persons of ordinary skill in the art. Accordingly, the invention is therefore to be limited only by the scope of the appended claims.

What is claimed is:

1. A bottom hole assembly for running on a wireline into production tubing of a wellbore, the bottom hole assembly comprising:

an upper end having a wireline connector releasably secured to the wireline;

a first packer disposed below the wireline connector;

a first drain sub having a first drain sub port in fluid communication with an upper bore of the bottom hole assembly;

an axial compression device disposed below the first packer, the axial compression device having an axially compressed position and an axially extended position;

a hydraulically actuated motor disposed below the axial compression device;

a ported sub disposed below the motor, the ported sub having a sub port; and a cutting tool disposed below the ported sub, the cutting tool operatively associated with the motor, said axial compression device selectively applying a force to said cutting tool when said cutting tool is operated by said motor.

2. The bottom hole assembly of claim 1, wherein the axial compression device comprises a compensator.

3. The bottom hole assembly of claim 2, further comprising a rupture disk sub disposed below the first packer and above the motor.

4. The bottom hole assembly of claim 3, further comprising a screen sub disposed below the rupture disk sub and above the motor.

5. The bottom hole assembly of claim 4, wherein the ported sub comprises a junk basket.

6. The bottom hole assembly of claim 1, wherein the axial compression device comprises an electric tractor operatively associated with a slack joint.

7. The bottom hole assembly of claim 6, further comprising a rupture disk sub disposed below the first packer and above the motor.

8. The bottom hole assembly of claim 1, further comprising a second packer disposed below the axial compression device and above the motor.

9. The bottom hole assembly of claim 8, further comprising a second drain sub disposed below the first packer and above the axial compression device, the second drain sub having a second drain sub port in fluid communication with the upper bore of the bottom hole assembly.

10. The bottom hole assembly of claim 9, further comprising a third drain sub disposed above the second packer and below the second drain sub, the third drain sub having a third drain sub port in fluid communication with a lower bore of the bottom hole assembly.

11. The bottom hole assembly of claim 10, wherein the ported sub comprises a junk basket.

12. The bottom hole assembly of claim 10, wherein a rupture disk sub is disposed in fluid communication with the upper bore of the bottom hole assembly between the first drain sub port and the second drain sub port.

13. The bottom hole assembly of claim 12, further comprising a screen sub disposed below the rupture disk sub.

14. The bottom hole assembly of claim 13, further comprising a jar tool disposed below the wireline connector and above the first drain sub.

15. The bottom hole assembly of claim 14, wherein the axial compression device comprises an electric tractor operatively associated with a slack joint.

16. A method of removing an object disposed within production tubing of a wellbore, the method comprising the steps of:

(a) running on a wireline a bottom hole assembly into a production tubing of a wellbore, the bottom hole assembly having a packer disposed below a drain sub, the drain sub having a port for fluid communication from the production tubing to a bore of the bottom hole assembly, an axial compression device disposed below the packer, the axial compression device having a an axially compressed position and an axially extended position, a hydraulically actuated motor disposed below the axial compression device, a ported sub disposed below the motor, the ported sub having a sub port in fluid communication with the bore of the bottom hole assembly, and a cutting tool disposed below the ported sub, the cutting tool being operatively associated with the motor;

(b) landing the cutting tool on an object disposed in the production tubing;

(c) actuating the packer to isolate a portion of the production tubing, the isolated portion of the production tubing being located below the packer and being in fluid communication with a production tubing port disposed in the production tubing, the production tubing port being in fluid communication with an annulus of the wellbore;

(d) pumping fluid down the production tubing, into the port of the drain sub and down the bore of the bottom hole assembly;

(e) actuating the motor by flowing the fluid through the motor and out of the sub port of the ported sub; and (f) rotating the cutting tool by actuation of the motor causing the cutting tool to mill the object;

wherein during said rotating the cutting tool, the axial compression device is moved from the compressed position toward the expanded position to exert an axial force on said cutting tool when rotated by said motor.

17. The method of claim 16, wherein the fluid flowing out of the sub port of the ported sub is flowed up the production tubing to the production tubing port and exits the production tubing through the production tubing port.

18. A method of removing an object disposed within production tubing of a wellbore, the method comprising the steps of:

(a) running on a wireline a bottom hole assembly into a production tubing of a wellbore, the bottom hole assembly having a packer disposed below a drain sub, the drain sub having a port for fluid communication from the production tubing to a bore of the bottom hole assembly, an axial compression device disposed below the packer, the axial compression device having a compressed position and an extended position, a hydraulically actuated motor disposed below the axial compression device, a ported sub disposed below the motor, the ported sub having a sub port in fluid communication with the bore of the bottom hole assembly, and a cutting tool disposed below the ported sub, the cutting tool being operatively associated with the motor;

(b) landing the cutting tool on an object disposed in the production tubing;

(c) actuating the packer to isolate a portion of the production tubing, the isolated portion of the production tubing being located below the packer and being in fluid communication with a production tubing port disposed in the production tubing, the production tubing port being in fluid communication with an annulus of the wellbore;

(d) pumping fluid down the production tubing, into the port of the drain sub and down the bore of the bottom hole assembly;

(e) actuating the motor by flowing the fluid through the motor and out of the sub port of the ported sub; and (f) rotating the cutting tool by actuation of the motor causing the cutting tool to mill the object;

wherein said rotating the cutting tool, the axial compression device is moved from the compressed position toward the expanded position;

wherein the fluid flowing out of the sub port of the ported sub is flowed up the production tubing to the production tubing port and exits the production tubing through the production tubing port;

wherein during step (f), a portion of the fluid flowing up the production tubing enters a junk basket disposed in the bottom hole assembly to capture debris carried in the fluid.

19. A method of removing an object disposed within production tubing of a wellbore, the method comprising the steps of:

(a) running on a wireline a bottom hole assembly into a production tubing of a wellbore, the bottom hole assembly having a first packer disposed below a first drain sub, the first drain sub having a first drain sub port for fluid communication from the production tubing to an upper bore of the bottom hole assembly, a second drain sub disposed below the first packer, the second drain sub having a second drain sub port for fluid communication from the production tubing to the upper bore of the bottom hole assembly, an axial compression device disposed below the second drain sub, the axial compression device having a compressed position and an extended position, a third drain sub disposed below the axial compression device, the third drain sub having a third drain sub port for fluid communication from the production tubing to a lower bore of the bottom hole assembly, a second packer disposed below the third drain sub, a hydraulically actuated motor disposed below the second packer, a ported sub disposed below the motor, the ported sub having a sub port in fluid communication with the lower bore of the bottom hole assembly, and a cutting tool disposed below the ported sub, the cutting tool being operatively associated with the motor;

(b) landing the cutting tool on an object disposed in the production tubing;

(c) actuating the first packer and the second packer to isolate a first portion, a second portion, and a third portion of production tubing, a first isolated portion being disposed above the first packer, the second isolated portion being disposed between the first packer and the second packer and the third isolated portion being disposed below the second packer, the third isolated portion being in fluid communication with the third drain sub port and a production tubing port disposed in the production tubing, the production tubing port being in fluid communication with an annulus of the wellbore;

(d) pumping fluid down the production tubing, into the first drain sub port of the first drain sub, down the upper bore of the bottom hole assembly, out of the second drain sub port of the second drain sub, down the production tubing, into the third drain sub port of the third drain sub, and down the lower bore of the bottom hole assembly;

(e) actuating the motor by flowing the fluid through the motor and out of the sub port of the ported sub; and (f) rotating the cutting tool by actuation of the motor causing the cutting tool to mill the object, wherein during said rotating the cutting tool, the axial compression device is moved from the compressed position toward the expanded position.

20. The method of claim 19, the fluid flowing out of the sub port of the ported sub is flowed within the production tubing to the production tubing port and exits the production tubing through the production tubing port.

* * * * *